United States Patent [19]

Faure

[11] 4,364,225

[45] Dec. 21, 1982

[54] MACHINE FOR PRODUCING SELF-TWISTING YARNS

[75] Inventor: Jean-Louis Faure, Roanne, France

[73] Assignee: ASA S.A., Villeurbanne, France

[21] Appl. No.: 184,277

[22] Filed: Sep. 5, 1980

[30] Foreign Application Priority Data

Sep. 20, 1979 [FR] France ..... 79 23871

[51] Int. Cl.[3] ..... D02G 3/28

[52] U.S. Cl. ..... 57/291; 57/293

[58] Field of Search ..... 57/6, 204, 205, 287, 57/288, 291, 293, 310, 315, 328–331

[56] References Cited

U.S. PATENT DOCUMENTS

| | | | |
|---|---|---|---|
| Re. 30,159 | 11/1979 | Kubler | 57/291 |
| 3,225,533 | 12/1965 | Henshaw | 57/34 |
| 3,468,120 | 9/1969 | Hildebrand | 57/204 X |
| 4,033,102 | 7/1977 | Vanhelle | 57/12 |
| 4,084,400 | 4/1978 | Movshovich et al. | 57/293 |
| 4,106,274 | 8/1978 | Eaves | 57/291 |
| 4,164,839 | 8/1979 | Schweizer | 57/293 |
| 4,215,642 | 8/1980 | Chambley | 57/204 X |

FOREIGN PATENT DOCUMENTS

| | | |
|---|---|---|
| 80014/75 | 4/1974 | Australia . |
| 7706336 | 2/1977 | France . |
| 7833108 | 12/1977 | France . |

*Primary Examiner*—Donald Watkins

*Attorney, Agent, or Firm*—Arnold, White & Durkee

[57] ABSTRACT

A machine for producing self-twisting yarns has a plurality of working positions at each of which is means for feeding a yarn to be treated and means for treating the yarn, there being an operator access zone between them. The means for treating the yarn include, arranged vertically, a positive yarn delivery device, for delivering two yarns in parallel, means for imparting an alternate twist to at least one of the two yarns, and for permitting the self-twisting of the two yarns around one another, and means for winding up the yarn produced.

15 Claims, 7 Drawing Figures

MACHINE FOR PRODUCING SELF-TWISTING YARNS

The present invention relates to a machine for producing yarns in accordance with the so-called "self-twisting" technique.

The technique of producing self-twisting yarns has been known for a long time and consists, in general terms, in combining at least two yarns, at least one of which possesses an alternate twist over its length, so that, when the yarns are placed side by side, they wind around one another. Preferably, both yarns have alternate twist, the zones where the twist is in the same direction in the two yarns being either in phase, or slightly out of phase, relative to one another.

A technique of this type is described in U.S. Pat. No. 3,225,533. It is used for treating either yarns with continuous filaments, or spun fibre yarns, or even, as further described in U.S. Pat. No. 4,033,102, self-twisting yarns, at least one of the constituent yarns of which has a core in its central part. Although this technique has been undergoing definite industrial development for a number of years, it has to be recognised that the self-twisting machines marketed hitherto do not fully satisfy the requirements of the users. In fact, these machines are very specialised, comprise a relatively small number of working positions and are difficult to use for satisfactorily treating textile materials of different natures and/or for fitting additional devices thereto, such as texturising and/or stretching devices, which would make it possible to produce yarns having different properties and characteristics.

According to the present invention there is provided a machine for producing self-twisting yarns, the machine comprising a plurality of identical working positions arranged side by side, each said position comprising means for feeding the yarn to be treated, and, separated from said feeding means so as to define an access zone for an operator, yarn-treating means arranged vertically on a common support, said yarn treating means comprising, from top to bottom of the support, (a) a positive yarn delivery device for delivering two yarns in parallel, (b) means to impart an alternate twist to at least one of the two yarns, and for permitting the self-twisting of the two yarns around one another, and (c) means for winding up the self-twisted yarn produced, said means for imparting twist and said means for winding up being separated by a zone in which said self-twisting can occur.

The machine of the invention is capable of producing a wide variety of self-twisting yarns and can easily be adapted for handling primary materials of very different natures, whilst at the same time being of simple design and easy to maintain and use.

In preferred embodiments, a device for drawing off the self-twisting yarn is arranged between the winding-up means and the zone in which the self-twisting of the two yarns around one another takes place.

Although it has been proposed, for instance in published French Patent Applications Nos. 2381845 and 2410065, to provide a machine in two distinct parts for false twist texturising, it has never hitherto been envisaged to apply such an arrangement to machines for producing self-twisting yarns. The reason for this may be appreciated by considering the actual process of producing self-twisting yarns. This process involves, in a first stage, treating the single yarns separately but in parallel, and then, in a second stage, immediately after an alternate twist has been imparted to at least one of the yarns, causing the winding and self-twisting of the two yarns around one another. Hitherto it has appeared essential and only possible to carry out this type of process when working horizontally, the yarn preferably being held on a guide surface. The only machines for self-twisting marketed hitherto have had this feature, as also has U.S. Pat. No. 4,164,839, which relates more particularly to the production of a core-containing yarn in which the fibrous envelope possesses an alternate twist.

However, it has now been found that a vertical arrangement of the treating members, and a vertical path for the material from top to bottom, is after all possible. Moreover, it leads, surprisingly, to advantageous results because it makes it possible not only to obtain uniform self-twisting yarns, but also to increase the production speeds. Furthermore, it is found that, in the case where at least one of the components possesses a core, the vertical arrangement of the stretching sleeves and the oblique incorporation of the core permit a better centering of the core in the fibres and avoid the use of additional means such as a blowing tube for bringing the core inside the rove of fibres.

Compared with the earlier machines for producing self-twisting yarns, a machine of the invention exhibits a number of advantages because it can easily be adapted for treating materials of a different nature, and for carrying out complementary treatments on these materials. Thus, if the yarn feeding can be carried out from bobbins arranged on a creel, the machine could easily be located in series with yarn-producing equipment, for example downstream of a machine for stretching synthetic yarns. It has also been noted that the clogging of the treating members is reduced, compared with machines in which the textile material is treated horizontally.

In the remainder of the description, the machine according to the invention will be described as using, for the yarn-feeding system, a creel which is arranged at the same level as the frame supporting the yarn-treating means, with the positive yarn delivery device delivering the material located close to the creel, but it is obvious, as stated previously, that this does not constitute a necessary limitation.

Also, in what follows there are described two delivery devices. That which is spaced further from the yarn-treating means will be designated by the expression "feed delivery device" and the other, which is arranged just upstream of the means for imparting the alternate twist will be designated by the expression "self-twisting delivery device".

It is possible to carry out complementary treatments, for example cold stretching of the treated yarn, between the feed delivery device and the self-twisting delivery device. Furthermore, it is also possible to arrange, between these two devices, a heat-treatment member, such as an oven or a stretching finger in the case where the treated yarn is unstretched or partially stretched. It is also possible to arrange a false twist texturising unit, such as an oven or spindle, or apparatus for any other similar treatment, in this zone.

A machine of the invention is particularly suitable for producing self-twisting yarns of the type described in U.S. Pat. No. 4,033,102, at least one of the components of which possesses a core. For this purpose, the self-twisting delivery device can consist of the last pair of rollers of a rove-stretching system, this stretching system preferably being arranged vertically above the treating members but also being able to have a different orientation if appropriate. In this case, the rove feeding can be carried out from bobbins held in the upper part of the frame. However, it is possible to feed directly from a tow which would be split before passing through the stretching system.

The invention will be more clearly understood from the following description which is given by way of example only with reference to the accompanying drawings in which:

FIGS. 1 and 2 respectively illustrate an end view and a front view of one working position of a machine according to the invention;

FIGS. 3 and 4 also illustrate an end view and a front view of a working position of a machine, according to the invention, which makes it possible to produce self-twisting yarns with a core;

Figure 2:
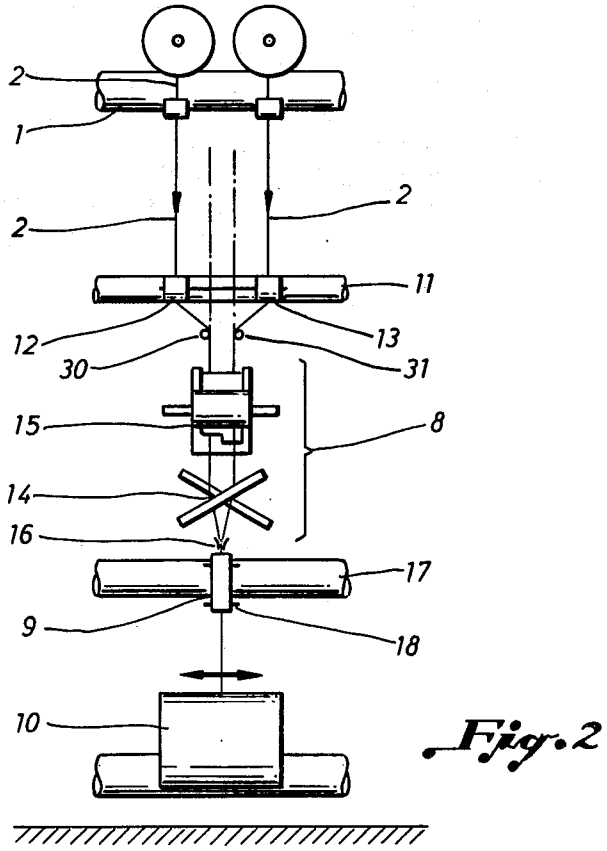
Figure 1:
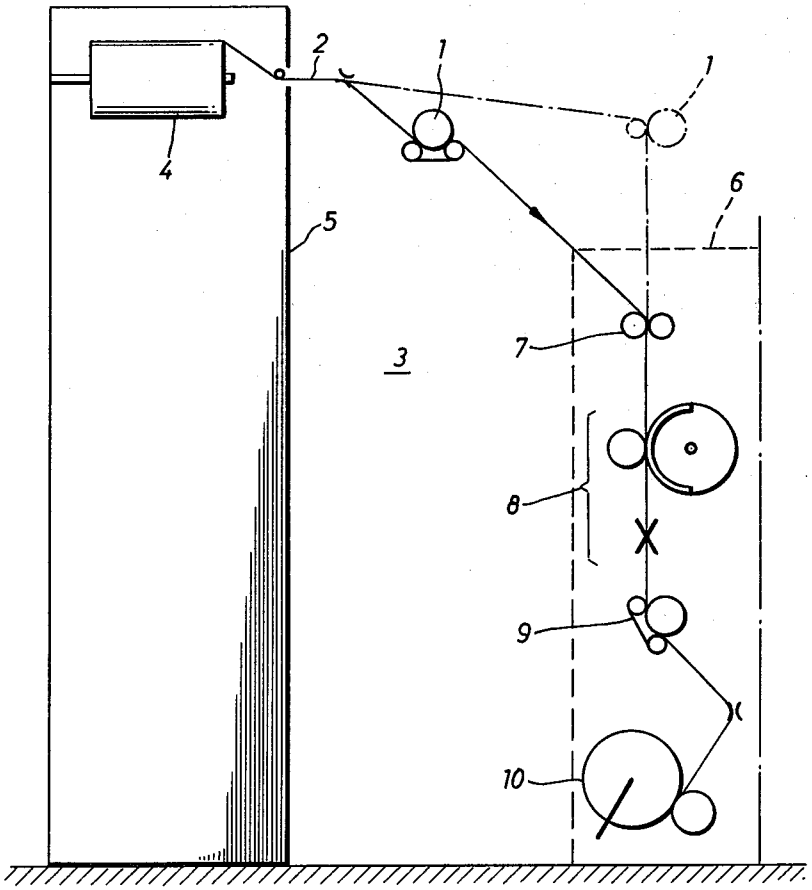

With reference to FIGS. 1 and 2, the machine according to the invention comprises a plurality of identical working positions arranged side by side on a support frame. At each position, in accordance with the invention, the supply of yarn 2 is separated from the actual yarn-treating means so as to form a passage 3 in which the operator can move. In this embodiment, the yarn 2 originates from bobbins stored on a conventional creel 5 arranged at the same level and spaced apart from the treating means. Optionally, the creel 5 could be located on a platform so as to make space available on the ground.

The yarn-treating means are grouped together on a common frame 6 which is shown in dotted lines in FIG. 1. These treating means consist, at the top, of a self-twisting delivery device 7 which makes it possible to deliver two yarns 2 in parallel. Then, conventional means 8 are arranged below this delivery device 7 to impart an alternate twist to the two yarns 2 which are being treated. Of course, it would suffice to impart this alternate twist to only one yarn. Finally, a further delivery device 9 is provided to draw off the self-twisting yarn produced, which is then wound up in a conventional manner at 10.

The self-twisting delivery device 7 used is, for example, a delivery device formed by a continuous shaft 11 which extends over the whole width of the machine, and on which wheels 12, 13 bear, and which makes it possible to deliver the yarns 2 individually.

Furthermore, the means 8 for imparting an alternate twist to the yarn consist of a unit comprising a false twist member 14, which is formed, for example, of crossed belts treating the two yarns 2 simultaneously. The alternate twist is obtained by varying the distance which the twist extends back between the member 14 and the self-twisting delivery device 7, for example by means of a conventional intermittent delivery device 15. The two single yarns 2 which have received an alternate twist are combined by simple self-twisting downstream of the spindle 14, the yarns being brought together by means of a guide 16.

The further delivery device 9 for drawing off the yarn formed can also consist of a continuous shaft 17 on which conventional individual sleeves 18 bear.

The winding-up at 10 is carried out in a conventional manner, for example by means of tangential pull. It is obvious that winding-up could also be carried out by means of a ring-and-traveller spindle in the case where, for example, it is desired to twist the yarn thus formed.

An installation of this type makes it possible easily to treat any type of yarn, whether it be based on continuous filaments or on spun fibre yarns.

Optionally, cold stretching can be carried out by adjusting the respective speeds of the feed delivery device 1 and the self-twisting delivery device 7.

It can also be noted that a machine of this type makes it possible to group two working positions together, back to back, on one and the same frame.

In the embodiment illustrated by FIGS. 1 and 2, the two yarns 2 which are to be subjected to self-twisting are introduced in parallel, and undergo a slight change in direction at the outlet of the self-twisting delivery device 11 due to the guides 30, 31 making it possible to reduce the space between the yarns. However, it would be possible to keep the space between these yarns constant throughout the initial part of the treatment, as is shown in dot-and-dash lines in FIG. 2. In this case, the guides 30, 31 could be omitted if appropriate. Furthermore, as is also shown in dot-and-dash lines in FIG. 1, the feed delivery device 1 could be arranged directly above, and in the same vertical plane as, the self-twisting delivery device 7 and the twisting means 8.

FIGS. 3, 4, 5, 6 and 7 illustrate certain modifications which can be applied in a simple manner to this machine.

Figure 4:
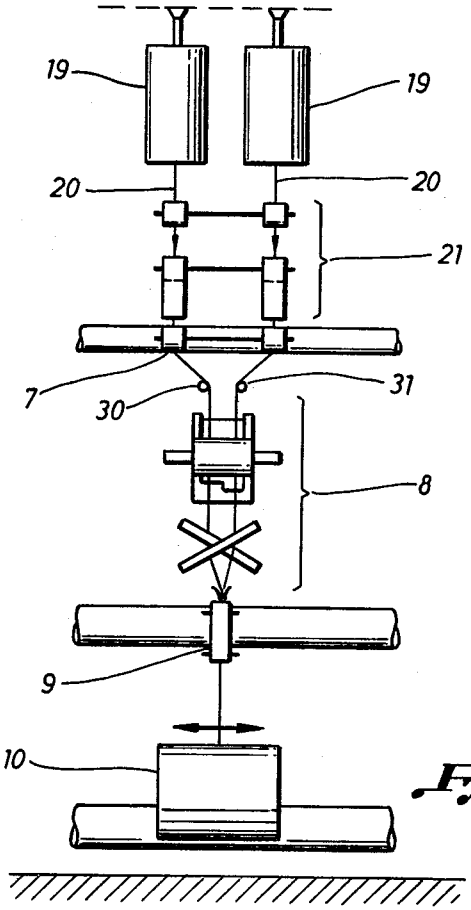
Figure 3:
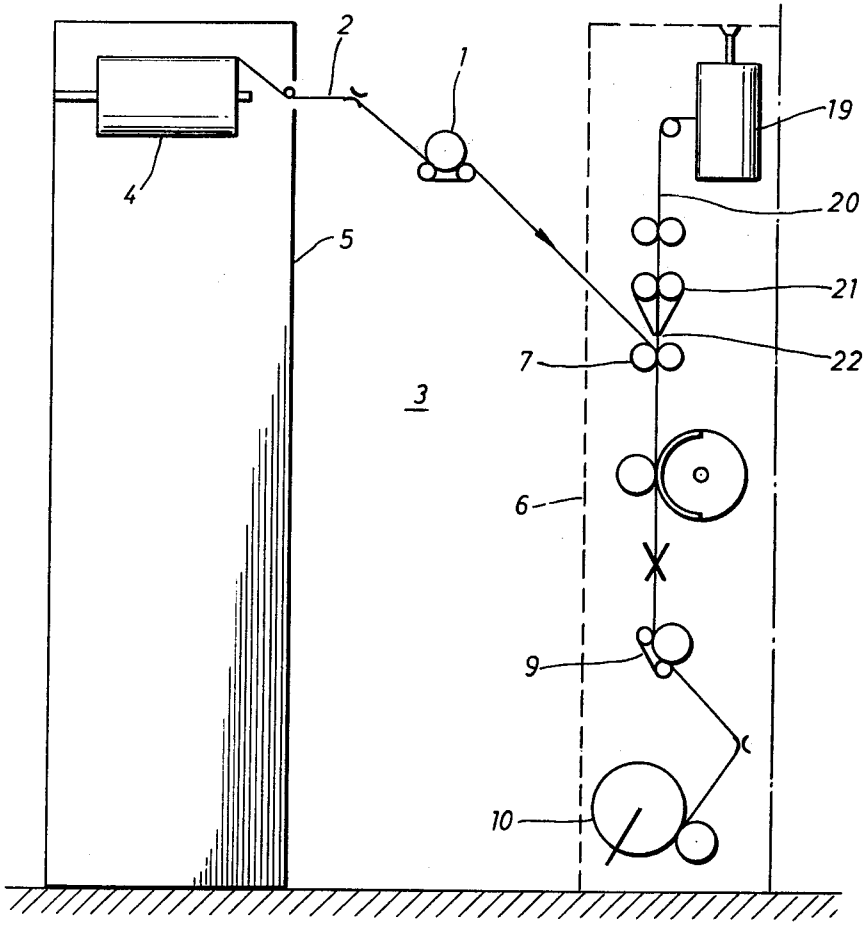

Thus, FIGS. 3 and 4 show an adaptation for the production of self-twisting yarns with a core. In this embodiment, a device 19 for feeding roves of fibres 20 is arranged in the upper part of the frame 6, and the self-twisting delivery device 7 consists of the last pair of rollers of a conventional stretching system, such as, for example, the system shown at 21 with a double sleeve.

In this embodiment, the core yarns consist of the yarns 2 originating from the creel 5, these yarns being incorporated into the rove 20 immediately upstream of the self-twisting delivery device 7, and it being possible to provide a condenser funnel 22 in this zone in order to facilitate the introduction of the core into the rove.

As in the embodiment illustrated by FIGS. 1 and 2, guides 30, 31 can be provided at the outlet of the self-twisting delivery device 7 in order to reduce the space between the yarns in the zone in which they are subjected to the twisting operation, but it is also possible to keep the distance between the yarns constant.

Figure 5:
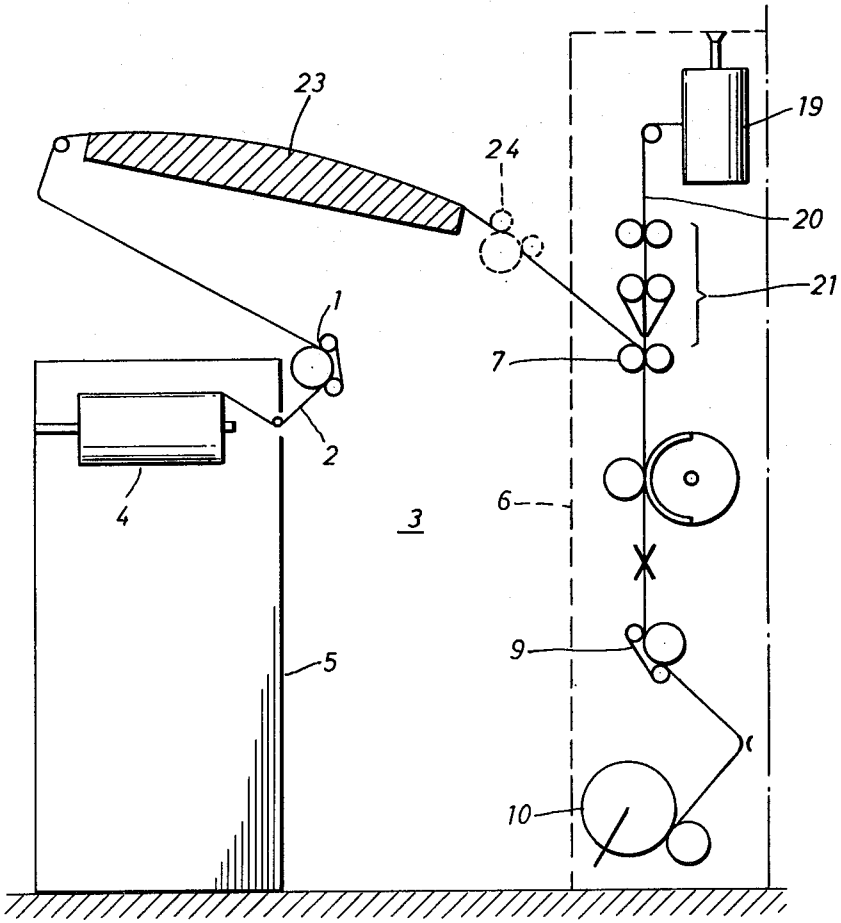
FIG. 5 illustrates a modification which makes it possible to carry out a complementary heat treatment on the material before the self-twisting operation.

FIG. 5 illustrates a modification in which a heat-treatment member 23, such as an oven, is arranged in the upper part of the machine. This oven 23, which can be open or closed, is preferably arranged horizontally or slightly obliquely, in the upper part of the machine. If appropriate, a complementary delivery device 24, shown in dotted lines in FIG. 5, can be provided at the outlet of the oven 23 so that cold stretching in cooperation with the feed delivery device 1 can be achieved.

This type of equipment can also be fitted with the above described system for feeding roves 20. In this case, the inclination of the oven 23 is such that the yarn 2 is introduced obliquely upstream of the last pair of rollers of the stretching system forming the self-twisting delivery device 7.

Figure 6:
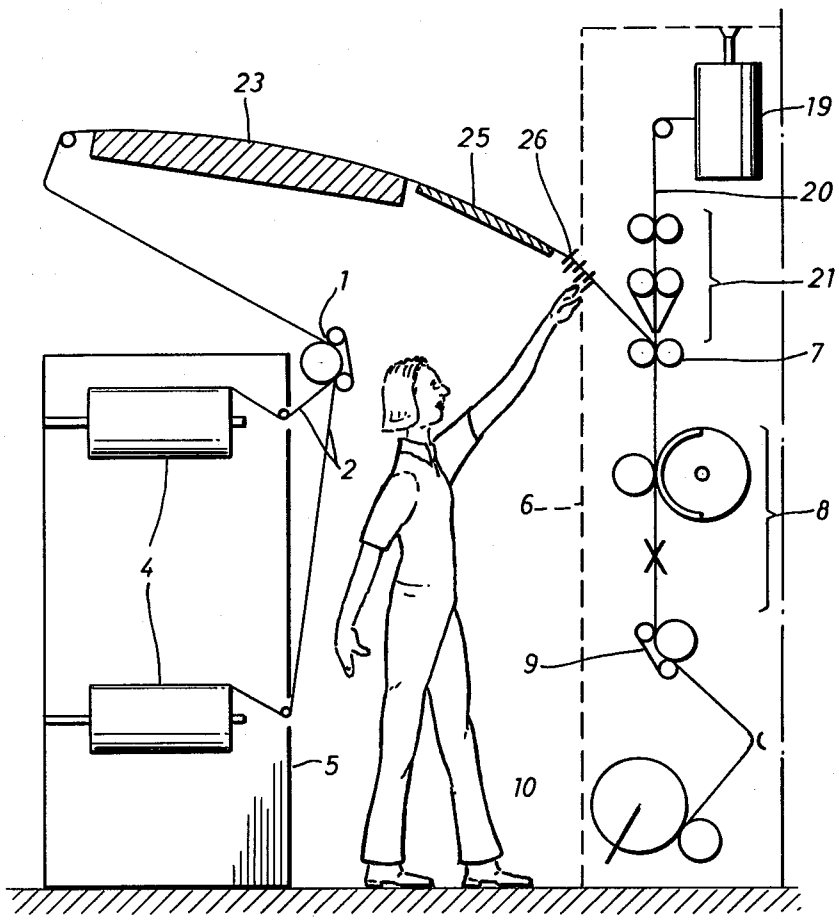
FIG. 6 illustrates a modification which makes it possible to carry out a texturising treatment on the material.

FIG. 6 illustrates a modification in which a false twist texturising operation is carried out by means of an oven 23, and spindle 26 between the feed delivery device 1 and the self-twisting delivery device 7. Of course, this texturising operation can be combined with simultaneous stretching of the yarn 2. A cooling plate 25 can be provided between the spindle 26 and the oven 23.

In all the preceding examples, the treating members are mounted symmetrically on a common frame.

Figure 7:
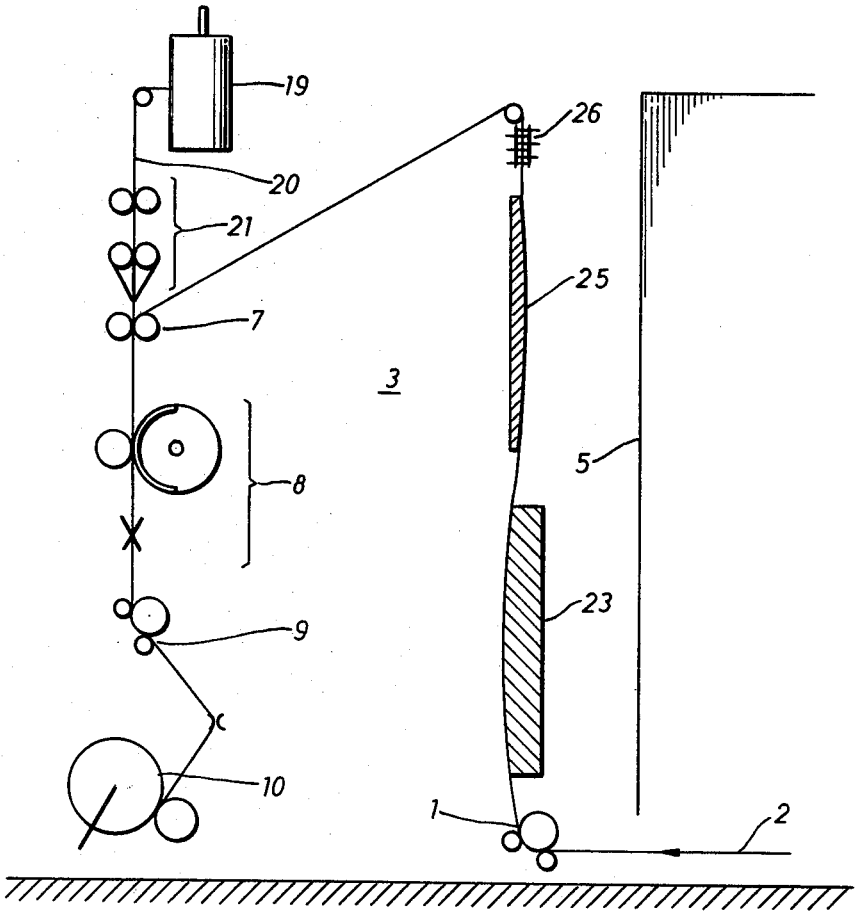
FIG. 7 illustrates another embodiment which combines such a texturising treatment with the self-twisting operation.

FIG. 7 illustrates a modification in which the feed delivery device 1, which, according to the invention, is separated from the treating members, is arranged at a lower level so that a texturising installation, for example a false twist texturising installation comprising an oven 23, a cooling plate 25 and a spindle 26, can be fitted between this delivery device and the treating members. In this embodiment, the passage zone 3 for the operator is located between the texturising zone and the treating zone.

If appropriate a system for introducing a rove 20 of fibres can again be provided in the upper part of the machine.

The preceding examples clearly show the advantages offered by the invention and the great flexibility of equipment of this type. Of course, the invention is not limited to these embodiments.

Furthermore, although this has not been described, it is obvious that the machine comprises means for detecting breaking and stopping, for each position, and can be equipped with any conventional means making it possible to treat the yarn correctly, for example tension regulators and suction systems which make it possible to effect the start-up operations correctly and/or to remove the fluff which could escape during the treatment.

I claim:

1. A machine for producing self-twisting yarns, the machine comprising a plurality of identical working positions arranged side by side, each said position comprising means for feeding the yarn to be treated, and, separated from said feeding means so as to define an access zone for an operator, yarn-treating means arranged vertically on a common support, said yarn treating means comprising, from top to bottom of the support, (a) a positive yarn delivery device for delivering two yarns in parallel, (b) means to impart an alternate twist to at least one of the two yarns, and for permitting the self-twisting of the two yarns around one another, and (c) means for winding up the self-twisted yarn produced, said means for imparting twist and said means for winding up being separated by a zone in which said self-twisting can occur.

2. A machine as claimed in claim 1, and further comprising, in each said position and between said self-twisting zone and said means for winding up, a device for drawing off the self-twisting yarn.

3. A machine as claimed in claim 1, wherein said means for feeding the yarn to be treated comprises bobbins arranged on a creel separated from the treating means by said access zone.

4. A machine as claimed in claim 3 including a feed delivery device arranged close to the creel.

5. A machine as claimed in claim 1 including a cold stretching device as a means to perform a complementary treatment between the yarn feeding means and the positive yarn delivery device.

6. A machine as claimed in claim 1, including a heat treating device between the yarn feeding means and the positive yarn delivery device as a means to perform a complementary treatment.

7. A machine for producing self-twisting yarns, the machine comprising a plurality of identical working positions arranged side by side, each said position comprising, means for feeding the yarn to be treated, and, separated from said feeding means so as to define an access zone for an operator, yarn treating means arranged vertically on a common support, said yarn treating means comprising, from top to bottom of the support, (a) a positive yarn delivery device for delivering two yarns in parallel, (b) means to impart an alternate twist to at least one of the two yarns, and for permitting the self-twisting of the two yarns around one another, and (c) means for winding up the self-twisted yarn produced, said means for imparting twist and said means for winding up being separated by a zone in which said self-twisting can occur, and a false twist texturizing device between the yarn feeding means and the positive yarn delivery device.

8. A machine for producing self-twisting yarns, the machine comprising a plurality of identical working positions arranged side by side, each said position comprising, means for feeding the yarn to be treated, and, separated from said feeding means so as to define an access zone for an operator, yarn treating means arranged vertically on a common support, said yarn treating means comprising, from top to bottom of the support, (a) a positive yarn delivery device for delivering two yarns in parallel, (b) means to impart an alternate twist to at least one of the two yarns, and for permitting the self-twisting of the two yarns around one another, and (c) means for winding up the self-twisted yarn produced, said means for imparting twist and said means for winding up being separated by a zone in which said self-twisting can occur, and further, including a system for stretching a rove arranged vertically above the treating means, and wherein said positive yarn delivery device is the last pair of rollers of said system.

9. A machine as claimed in claim 8 including bobbins above the treating means for feeding said roves.

10. A machine as claimed in claim 8, and further comprising, in each said position and between said self-twising zone and said means for winding up, a device for drawing off the self-twisting yarn.

11. A machine as claimed in claim 8, wherein said means for feeding the yarn to be treated comprises bobbins arranged on a creel separated from the treating means by said access zone.

12. A machine as claimed in claim 11 including a feed delivery device arranged close to the creel.

13. A machine as claimed in claim 8 including a cold stretching device as a means to perform a complementary treatment between the yarn feeding means and the positive yarn delivery device.

14. A machine as claimed in claim 8 including a heat treating device as a means to perform a complementary treatment between the yarn feeding means and the positive yarn delivery device.

15. A machine as claimed in claim 8 including a false twist texturizing device between the yarn feeding means and the positive yarn delivery device.

* * * * *